US006062291A

United States Patent [19]

Morgan et al.

[11] Patent Number: 6,062,291

[45] Date of Patent: May 16, 2000

[54] VENETIAN BLIND FOR PALLADIAN-STYLE WINDOW

[75] Inventors: Joe N Morgan, Otterbein; Jay R Cleaver, Lafayette; Richard E Lamay, West Lafayette, all of Ind.

[73] Assignee: Lafayette Venetian Blind, Inc., Indianapolis, Ind.

[21] Appl. No.: 09/155,224

[22] PCT Filed: Mar. 27, 1997

[86] PCT No.: PCT/US97/04913

§ 371 Date: Jan. 21, 1999

§ 102(e) Date: Jan. 21, 1999

[87] PCT Pub. No.: WO97/36081

PCT Pub. Date: Oct. 2, 1997

Related U.S. Application Data

[60] Provisional application No. 60/014,357, Mar. 28, 1996.

[51] Int. Cl.[7] ..... E06B 9/28

[52] U.S. Cl. ..... 160/176.1 R; 160/172 R

[58] Field of Search ..... 160/172 R, 107, 160/134, 84.07, 236, 173 R, 176.1 R; 49/86.1, 74.1, 64

[56] References Cited

U.S. PATENT DOCUMENTS

| | | | |
|---|---|---|---|
| 327,235 | 9/1885 | Clapp . | |
| 1,951,659 | 3/1934 | Kesner . | |
| 2,061,373 | 11/1936 | Brent et al. . | |
| 2,139,781 | 12/1938 | Trammell . | |
| 2,187,242 | 1/1940 | Kesner . | |
| 2,234,804 | 3/1941 | Murray . | |
| 2,276,177 | 3/1942 | Flugger . | |
| 4,503,900 | 3/1985 | Otsaka et al. . | |
| 4,518,025 | 5/1985 | Judkins | 160/168.1 R |
| 4,552,196 | 11/1985 | Vecchiarelli . | |
| 4,602,456 | 7/1986 | Tatro . | |
| 4,776,380 | 10/1988 | Lester | 160/134 |
| 4,934,436 | 6/1990 | Schnebly . | |
| 5,537,780 | 7/1996 | Cleaver et al. . | |
| 5,584,329 | 12/1996 | Thomas | 160/134 |
| 5,632,316 | 5/1997 | Cohen | 160/236 X |

*Primary Examiner*—David M. Purol
*Attorney, Agent, or Firm*—Woodard, Emhardt, Naughton Moriarty & McNett

[57] ABSTRACT

Base rail (12) and arch rail (13) frame holds horizontal slats (14). The frame (12, 13) is removable from a window opening for service. The slats (14) are mounted on ladders (17) with notches (31, 32) in the slats for removal individually. The base rail (12) opens down and receives a closure piece removable for access to the mechanism. Guide plates (21) on the arch rail (13) facilitate sliding the ladder cords (18, 19) forward and rearward for tilting the slats (14) without mechanism external to the base rail (12) or arch rail (13), other than the ladder cords (18, 19) themselves. The arch rail (13) inside face is channeled to receive slat ends to obscure direct line of sight through the assembly when the slats (14) are closed. Slat ends are chamfered for tilting the slats (14) without interference with the inner surface of the arch rail (13) when the slats (14) are closed.

15 Claims, 1 Drawing Sheet

VENETIAN BLIND FOR PALLADIAN-STYLE WINDOW

Claims provisional application Ser. No. 60/014,357 filed on Mar. 28, 1996.

BACKGROUND OF THE INVENTION

Field of the Invention

This invention relates generally to window coverings and more particularly to a venetian blind for palladian-style windows.

For window coverings, some kinds of venetian blinds have been proposed for windows that do not have a straight horizontal header. Also, there are wood shutter assemblies for palladian-style windows. Some decorators and owners prefer venetian blinds for aesthetic compatability with other venetian blinds, and/or for light control different from what shutters provide. It is desirable to provide a venetian blind assembly that is durable, can be closed or opened with either a forward or backward tilt of the slats, and is comparatively easy to clean or service. The present invention is directed to achieving one or more of these features.

SUMMARY OF THE INVENTION

Described briefly, according to a typical embodiment of the present invention, a frame including a base rail and arch rail is provided with a set of horizontal slats which, when closed, obscure direct line of sight through the assembly and minimize light transmission through it. This assembly can be inserted in a window opening, but removable therefrom for service. It includes a set of horizontal slats mounted on ladder assemblies with notches in the slats to facilitate removal thereof for cleaning, but without disassembly of the entire blind assembly. The bottom rail is open at the bottom to accommodate a closure piece, but enable removal thereof to gain access to the mechanism, if needed for service. Guide plates are provided on the inner surface of the arch rail to accommodate sliding of the ladder cords forward and rearward to enable tilting the slats without mechanism external to the base rail or arch rail, other than the ladder cords themselves. The inside face of the arch rail is channeled to accommodate slat ends to obscure direct line of sight through the assembly when the slats are closed. Ends of slats are chamfered to facilitate tilting of the slats without interference with the inner surface of the arch rail when the slats are closed.

DESCRIPTION OF THE PREFERRED EMBODIMENT

Figure 1:
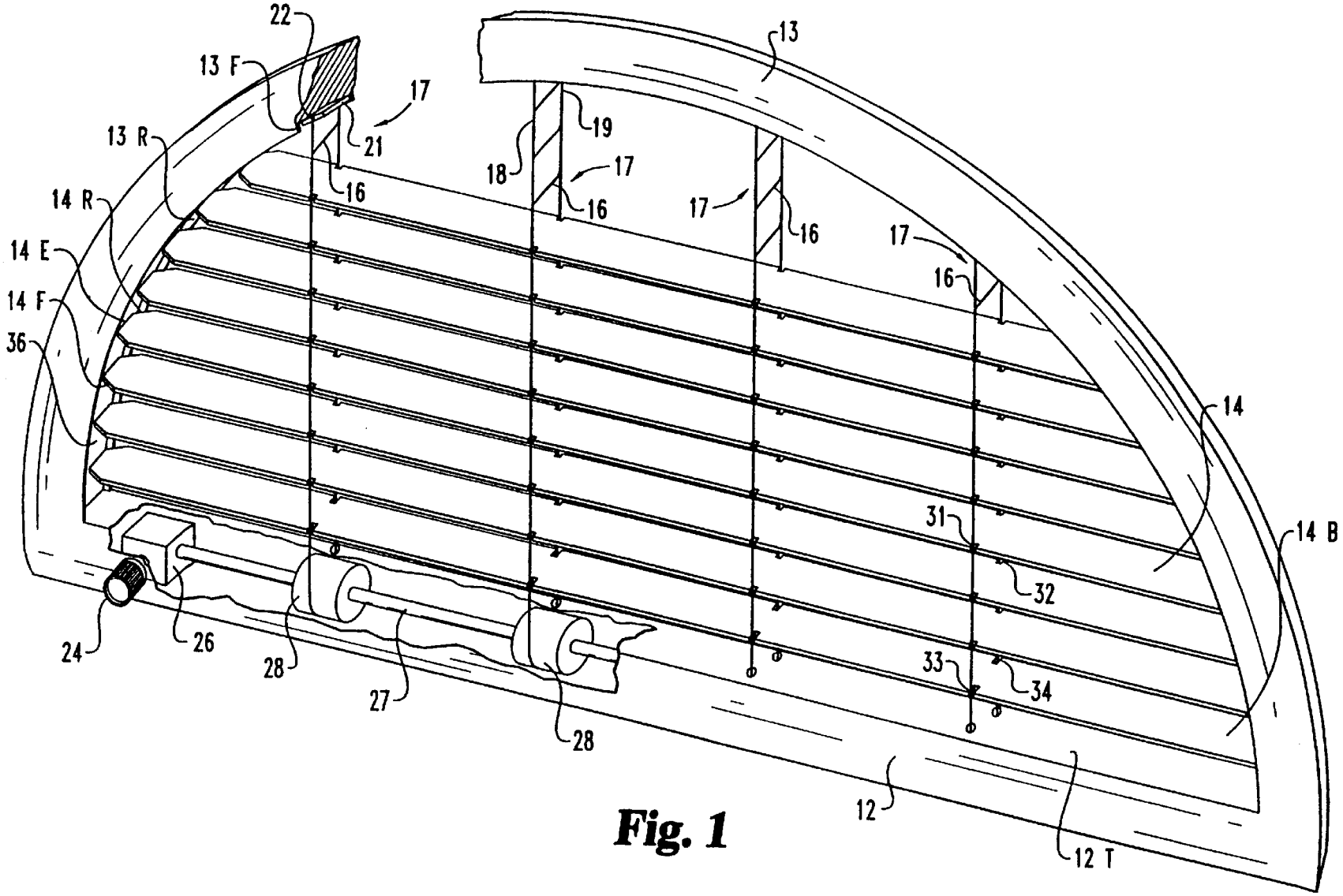
FIG. 1 is a perspective view of a venetian blind assembly for a palladian-style window with portions broken out to show some interior details.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawing in detail, the assembly is made primarily of wood and includes a base rail 12 of downwardly-opening channel-shaped cross section. An arch rail 13 is secured to the ends of the base rail. There is a plurality of wood slats 14 supported on ladder rung strands 16 on each of the ladder assemblies 17. The ladder rung strands 16 are woven into the ladder cords at the front (room side) 18 and rear (window side) 19 of the assembly. The ladder cord is guided at the top of each ladder assembly by a guide plate 21 having a groove 22 between the plate and the underside of the arch rail 13 so the ladder cord can slide forward and rearward in the groove to permit tilting of the slats forward or rearward.

A control knob 24 is provided at the front of the base rail 12 and operates through a right-angle drive box 26 to operate the rocker shaft 27 which extends to the right from the drive box 26. Ladder operating drums 28 are non-rotatably mounted at spaced points along the length of the rocker shaft 27. The lower ends of the ladder cords are fastened to these drums so that, upon turning the knob 24, the slats can be opened or closed in either the forward or rearward direction.

Each of the slats has notches such as 31 at the front edge and 32 at the rear edge which receive the ladder cords 18 and 19, respectively. These notches are sufficiently shallow (from the front edge toward the rear edge, and vice versa, of the slat) so that, even though the ladder cords are fully received in them, the slats adjacent to each other overlap to block light from passing through from the front to the rear at these notches when the slats are closed. Extra deep notches 33 and 34 can be provided in the lower slat 14B to enable that slat to slide down on the support strands such as 16 for that slat when the blind is closed, sliding sufficiently down to enable the down edge of the slat to rest on the top surface 12T of the bottom rail, thus blocking any light transmission under that slat. The slats can be removed independently from each other to clean them, without disassembly of the blind.

The inside face of the arch rail 13 is recessed as shown at 36 between front and rear flanges 13F and 13R at the front and rear, respectively, of the arch rail, so the inside face of it is a shallow channel. The ends 14E of the slats are received in the recess so that, when the blind is closed, there is no direct line of sight through the closed blind from one face to the other. The edges 14F and 14R at the front and rear of the slats are chamfered at both of the ends of the slats as shown so as to avoid interference with the inside face 36 of the arch rail channel as the blind is closed either forward or rearward.

Conventional materials can be used in the construction of the blind. An additional slat such as 14, with the same shallow depth of notches as the slats above it, can be placed on top of slat 14B if additional light sealing is needed upon closure of the blind. Instead of the knob 24, a tilt control cord or cords can be used for tilting the slats. Also, a tilt control wand could be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A venetian blind for palladian-style window comprising:

a base rail;

an arch rail having ends securely mounted to the base rail to provide a unitary window frame;

a plurality of parallel slats in a space between the arch rail and the base rail;

a ladder receiving the slats therethrough, the ladder including an operating cord having a lower end;

a cord puller mounted to the base rail and receiving the lower end of the cord; and a controller coupled to the cord puller and operable to selectively pull on the cord, operating the ladder to tilt the slats.

2. The blind of claim 1 and wherein:

the arch rail has an inner surface toward the center of the arch rail, and a channel on the inner surface.

3. The blind of claim 2 and wherein:

the slats have ends chamfered and fittingly received in the channel.

4. The blind of claim 2 and wherein:

the slats are of a uniform width throughout most of their length, and the width of the slats is reduced at their ends to fit into the arch rail channel.

5. The blind of claim 2 and wherein:

the slats have a uniform width throughout most of their length and are spaced apart a distance which is smaller than the width of the slats and closely enough to overlap when closed.

6. The blind of claim 1 and wherein:

the slats have front and rear edges with notches in the edges slidably receiving the operating cord in the notches.

7. The blind of claim 6 and wherein:

the notches are sized to fittingly receive the ladder cord and permit the slats adjacent to each other to overlap when the slats are closed to inhibit light passage through the notches when the slats are closed.

8. The blind of claim 7 and wherein:

the slats include a lowest slat having notches deeper than those in the rest of the slats to enable downward slippage onto the base rail to block light transmission between the base rail and the lowest slat when the slats are closed.

9. The blind of claim 1 and wherein:

the cord puller is a drum with the operating cord wrapped on the drum in one direction to tilt the slats closed in one direction, and wrapped on the drum in an opposite direction to tilt the slats closed in the opposite direction.

10. The blind of claim 1 and wherein:

the base rail, the arch rail and the slats are made of wood.

11. A venetian blind for a palladian-style window, comprising:

a base rail;

an arch rail having ends mounted to the base rail;

a plurality of parallel slats in a space between the arch rail and the base rail;

a ladder receiving the slats therethrough, the ladder including an operating cord having a lower end;

a cord puller mounted to the rail and receiving the lower end of the cord;

a controller coupled to the cord puller and operable to selectively pull on the cord, operating the ladder to tilt the slats; and a guide plate fastened to an inner surface of the arch rail, the guide plate cooperating with the arch rail surface to slidably receive the operating cord therethrough, the guide plate supporting the upper end of the ladder and permitting the operating cord to slide therethrough as the ladder is operated to tilt the slats.

12. The blind of claim 11 and wherein:

the plate has a groove slidably receiving the operating cord.

13. A venetian blind for a palladian-style window, comprising:

a base rail;

an arch rail having ends mounted to the base rail;

a plurality of parallel slats in a space between the arch rail and the base rail;

a ladder receiving the slats therethrough, the ladder including an operating cord having a lower end;

a cord puller mounted to the rail and receiving the lower end of the cord;

a controller coupled to the cord puller and operable to selectively pull on the cord, operating the ladder to tilt the slats;

wherein the cord puller is a drum with the operating cord wrapped on the drum in one direction to tilt the slats closed in one direction, and wrapped on the drum in an opposite direction to tilt the slats closed in the opposite direction, and wherein the base rail has a downwardly-opening cavity therein receiving the drum.

14. The blind of claim 13 and further comprising:

a rocker shaft mounting the drum;

a right-angle drive device connected to the controller and to the rocker shaft.

15. The blind of claim 14 and wherein:

the controller is a control knob at the front of the base rail.

* * * * *

UNITED STATES PATENT AND TRADEMARK OFFICE

CERTIFICATE OF CORRECTION

PATENT NO : 6,062,291

DATED : May 16, 2000

INVENTOR(S) : Joe N. Morgan et al.

It is certified that error appears in the above-identified patent and that said Letters Patent are hereby corrected as shown below:

On the title page, item:

[73] of the title page, please delete "Indianapolis, Ind." and insert in lieu thereof --West Lafayette, Ind.--.

In col. 1, lines 4 and 5, please delete "Claims provisional application Ser. No. 60/014,357 filed on Mar. 28, 1996" and insert in lieu thereof --The present application claims priority to U.S. Provisional Application Ser. No. 60/014,357 filed on Mar. 28, 1996--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*